United States Patent [19]

Befeld

[11] Patent Number: 4,737,245

[45] Date of Patent: Apr. 12, 1988

[54] METHOD FOR UNIFORMLY ELECTROLYTICALLY COLORING ANODIZED ALUMINUM OR ALUMINUM ALLOYS

[75] Inventor: Willi Befeld, Hamm, Fed. Rep. of Germany

[73] Assignee: Chemal GmbH & Co. KG, Hamm, Fed. Rep. of Germany

[21] Appl. No.: 900,834

[22] Filed: Aug. 27, 1986

[30] Foreign Application Priority Data

Aug. 29, 1985 [DE] Fed. Rep. of Germany ..... 3530934

[51] Int. Cl.[4] ..... C25D 11/22

[52] U.S. Cl. ..... 204/37.6; 204/42

[58] Field of Search ..... 204/37.6, 42

[56] References Cited

U.S. PATENT DOCUMENTS 4,316,780 2/1982 Yoshida et al. ..... 204/37.6

4,421,610 12/1983 Rodriguez ..... 204/37.6

*Primary Examiner*—John F. Niebling

*Assistant Examiner*—William T. Leader

*Attorney, Agent, or Firm*—Becker & Becker, Inc.

[57] ABSTRACT

A method for electrolytically coloring anodized aluminum and aluminum alloys in a reproducible manner so that they are of uniform color is provided. The anodized aluminum or aluminum alloy is anodically treated and then electrolytically colored in a solution capable of forming a barrier layer. Prior to the anodic treatment, the counterelectrodes are activated using a direct voltage of 2 to 9 volts between the counterelectrodes, as anodes, and auxiliary electrodes, as cathodes. The process includes the additional step, after anodic treatment and prior to coloring, of maintaining the aluminum or aluminum alloy for a currentless waiting time of from 0.5 to 5 minutes in the treatment solution.

4 Claims, No Drawings

METHOD FOR UNIFORMLY ELECTROLYTICALLY COLORING ANODIZED ALUMINUM OR ALUMINUM ALLOYS

BACKGROUND OF THE INVENTION

The present invention relates to a method for uniformly electrolytically coloring anodized aluminum or aluminum alloys in a reproducible manner, whereby the goods that are to be colored, even greatly profiled pieces, can be suspended close to one another in several rows, and whereby the surface of the goods that are to be colored, even greatly profiled pieces, is considerably increased and the surfaces are colored in a uniform manner.

DESCRIPTION OF THE PRIOR ART

For electrolytically coloring anodized oxide layers, it is known in a coloring bath that contains a metallic salt, to deposit metals or metal oxides electrolytically into the pores of the layer with alternating or direct current. This method is customary on a large scale, and the anodized oxide layers thus colored have a high resistance to weather. However, the coloring of the layers is not uniform; greatly profiled pieces in particular often show deviations in color.

The goods surface that is to be colored is also limited; it is customary to handle only one bar of goods in the coloring bath, or, if two bars of goods are present, to use a central electrode.

German Patent No. 25 38 622 Yanagida et al issued Nov. 24, 1987 discloses a coloring method for anodized oxide layers, according to which, to increase the uniformity of the color, the goods, prior to cathodic coloring, are anodically treated, prior to the coloring, in a bath that contains the same metal ions as does the coloring bath. The object of this method is to improve the uniformity of the coloring without having disruptions due to impurities in the coloring bath or due to changes in the pH value.

German Patent No. 26 09 146 Hasegawa et al issued Nov. 23, 1978 discloses a coloring method for anodized oxide layers, according to which, to increase the uniformity of the color, the goods are anodically treated in the same coloring bath during coloring via an alternating current. The coloring bath contains at least three metallic salts, or at least two metallic salts and one greatly reducing compound. Furthermore, this coloring bath is treated with an inorganic or an organic acid.

German Patent No. 24 07 860 Rodriquez issued Apr. 12, 1979 discloses a coloring method for increasing the uniformity of the color for anodized oxide layers, according to which the coloring bath contains a metallic salt solution, an auxiliary salt, e.g. a copper salt, and a pH value to 1.8 is set. During the coloring, a modified alternating voltage is used. In particular, the alternating voltage is symmetrically sinusoidal or square having the cycle 2 N, respectively between 0.5 N long positive and 0.5 N long negative voltage zones, 0.5 N long voltage-less zones, or symmetrically sinusoidal, respectively between N long positive-negative voltage zones, N long voltage-less zones.

With the method described in German Patent No. 25 38 622 Yanagida et al issued Nov. 24, 1977, it is only possible to achieve an improvement in the uniformity of the color if the coloring bath that is used, in addition to the aforementioned metallic ions, also contains barrier layer or protective layer former. Up to now, this critical relationship was not recognized. Furthermore, a cathodic coloring is not commercially customary, because it is difficult to realize. A cathodic coloring of goods suspended in a plurality of rows has not been tried to date. In contrast, the use of alternating current is currently the state of the art for electrolytic coloring. A reproducible improvement of the color uniformity is not possible with this method.

With the method described in German Patent No. 26 09 146 Hasegawa et al issued Nov. 23, 1978, an improvement of the color uniformity can again be achieved only if the coloring bath that is used, in addition to the aforementioned metallic ions, also contains protective layer former. Up to now, this critical relationship was not recognized. Not necessary is the presence of "at least three metallic salts or at least two metallic salts and one greatly reducing compound"; however, what is mandatory is the presence of a protective layer former, as was recognized by the present invention.

A reproducible improvement of the color uniformity is not possible with the above method, since the phenomena that occur during the process at the counterelectrode and the goods are not taken into account.

With the method described in German Patent No. 24 07 860 Rodriques issued Apr. 12, 1979 for coloring anodized oxide layers, again an improvement of the color uniformity can be achieved only if the coloring bath that is used, in addition to the aforementioned metallic ions, also contains barrier layer or protective layer former. Up to now, this critical relationship was not recognized. Not necessary is the presence of an "auxiliary salt" in the coloring bath, as was recognized by the present invention. The use of modified alternating voltage during coloring is too expensive in practice. A reproducible improvement of the color uniformity is not possible with the aforementioned method, since the phenomena that occur during the process at the counterelectrode and the goods are not taken into consideration.

An object of the present invention is to achieve in a reproducible manner a uniform coloring of goods that are suspended in several rows next to one another, and which can be greatly profiled, and to achieve this in a coloring bath without uneconomically changing the current supply or the composition of the coloring bath.

SUMMARY OF THE INVENTION

To realize this object, pursuant to the present invention the resistances of the anodized oxide layers that are to be colored, which resistances are a function of the thickness of the barrier layer or protective layer, are altered in such a way by an anodic treatment in a protective layer former bath or in a coloring bath having a protective layer former additive, that during an electrolytic coloring not only those anodized oxide layers that face the electrodes but also those that face away from the electrodes can be colored uniformly. A reproducible, uniform coloring is achieved if prior to the anodic treatment of the goods, the counterelectrodes are subjected to activation (application of a direct voltage between the counterelectrodes and the auxiliary electrodes), and if after the anodic treatment the pieces that are to be colored remain in the coloring bath in a current-less state.

The subject matter of the present invention is thus a method for electrolytically coloring aluminum or aluminum alloys in a reproducible manner so that they are of uniform color, with the method being characterized in that the protective layer of the oxide that is to be colored is altered in such a way by anodic use of a protective layer former that a uniform electrolytic coloring is possible.

The protective layer alteration is preferably effected by anodic treatment of the goods in a bath having a protective layer former solution which contains, for example, salts of tartaric acid, boric acid, sulfosalicylic acid, citronic acid, glycolic acid, and the like, and the electrolytic coloring is effected in a subsequent coloring bath via alternating current.

Pursuant to a further embodiment of the inventive method, the protective layer alteration can be effected by anodic treatment and the electrolytic coloring can be effected via alternating current in a coloring bath having a protective layer former additive.

The anodic treatment is preferably effected for 10 to 200 seconds at 15 to 30 V.

It is expedient, after the anodic treatment and prior to the coloring, to maintain a currentless waiting time of from 0.5 to 5 minutes.

It is furthermore expedient, prior to the anodic treatment and subsequent coloring in a bath, to activate the counterelectrodes used during coloring by applying a direct voltage of from 2 to 7 V between the counterelectrodes (as anode) and the auxiliary electrodes (as cathode) for 5 to 30 seconds.

An important advantage of the inventive method is that the coloring bath can be filled with goods that are disposed next to one another in several rows, whereby a uniform coloring can be achieved over the entire surface.

BEST MODES FOR CARRYING OUT THE INVENTION

The present invention will subsequently be described in greater detail with the aid of examples.

EXAMPLE 1

Two AlMg 1-sheets ($30\times40$ cm$^2$) are suspended at a distance of 20 mm from one another, are anodized (layer thickness 20 μm), and are anodically treated for one minute at 18 V and at 20° C. in a bath having 30 g/l ammonium acetate as protective layer former and stainless steel counterelectrodes (V4A), and are thereafter moved at 20° C. into a coloring bath having 15 g/l $SnSO_4$ and 20 g/l $H_2SO_4$. After 2 minutes waiting time, the sheets are electrolytically colored at 18 V for 10 minutes.

The sheets are a uniform shade of black on the inner and outer sides. (Light point tolerance pursuant to the Dr.-Lange-measuring device UME $1\pm5$ light points.)

For comparison, two sheets that were similarly suspended and were provided with a 20 μm anodized layer were electrolytically colored without using the inventive procedure. The inner side of the sheets were 80–90 light points lighter than the outer sides.

EXAMPLE 2

Two AlMg 1-sheets ($30\times40$ cm$^2$) are suspended at a distance of 20 mm from one another, are anodized (20 μm layer thickness), and are moved into a bath (20° C.) having 15 g/l $SnSO_4$, 20 g/l $H_2SO_4$, and as protective layer former 5 g/l sulfosalicylic acid. The counterelectrodes (V4A) are connected as anodes, and the auxiliary electrodes (V4A rods) are connected as cathodes; a voltage of 8 V is subsequently applied to. 15 seconds. After this electrode activation, a voltage of 25 V is applied for 30 seconds between the sheets as anodes and counterelectrodes as cathodes; the sheets subsequently remain current-less in the bath for 3 minutes.

After the current-less retention time, the sheets are electrolytically colored at 18 V in 10 minutes. The sheets are a uniform shade of black on the inner and outer sides. (Light point tolerance pursuant to the Dr.-Lange-measuring device UME $1\pm5$ light points).

For comparison, two sheets are similarly suspended and provided with a 20 μm anodized oxide layer and are electrolytically colored without resorting to the inventive procedure. The inner sides of the sheets are 80–90 light points lighter than the outer sides.

EXAMPLE 3

Two AlMg 1-sheets ($30\times40$ cm$^2$) are suspended at a distance of 20 mm from one another, are anodized (20 μm layer thickness), and are moved into a 20° C. bath having 50 g/l $NiSO_4.6\ H_2O$, 25 g/l $MgSO_4.7\ H_2O$, 15 g/l $(NH_4)_2SO_4$, 25 g/l $HSO_3NH_2$, and as protective layer former 50 g/l boric acid. The counterelectrodes (nickel plates) are connected as anodes, and the auxiliary electrodes (nickel rods) are connected as cathodes; subsequently, a voltage of 8 V is applied for 30 seconds.

After this electrode activation, a voltage of 23 V is applied for 40 seconds between the sheets as anodes and the counterelectrodes as cathodes; subsequently, the sheets remain current-less in the bath for 3 minutes.

After the current-less retention time, the sheets are electrolytically colored dark bronze at 15 V in 5 minutes.

The sheets have a uniform color on the inner and outer sides. (Light point tolerance pursuant to the Dr.Lange-measuring device UME $1\pm5$ light points.) For comparison, two plates that have been similarly suspended and provided with a 20 μm anodized oxide layer are electrolytically colored without resorting to the inventive procedure. The inner sides of the sheets are 80–90 light points lighter than the outer sides.

EXAMPLE 4

Two AlMg 1-sheets ($30\times40$ cm$^2$) are suspended at a distance of 20 mm from one another, are anodized (20 μm layer thickness), and are moved into a 20° C. bath having 100 g/l $CoSO_4.7\ H_2O$, 190 g/l $MgSO_4.7\ H_2O$, and as protective layer former 40 g/l boric acid and 10 g/l tartaric acid.

The counterelectrodes (V4A) are connected as anodes, and the auxiliary electrodes (V4A-rods) are connected as cathodes; subsequently, a voltage of 8 V is applied for 30 seconds.

After this electrode activation, a direct voltage of 22 V is applied for 40 seconds between the sheets as anodes and the counterelectrodes as cathodes; subsequently, the sheets remain currentless in the bath for 3 minutes.

After the current-less retention time, the sheets are electrolytically colored at 18 V for 20 minutes.

The sheets have a uniform color on the inner and outer sides. (Light point tolerance pursuant to the Dr.-Lange-measuring device UME $1\pm5$ light points).

For comparison, two sheets that are similarly suspended and are provided with a 20 μm anodized oxide layer are electrolytically colored without resorting to the inventive procedure. The inner sides of the sheets are 80–90 light points lighter than the outer sides.

EXAMPLE 5

Two AlMg 1-sheets ($30\times40$ cm$^2$) are suspended at a distance of 20 mm from one another, are anodized (20 μm layer thickness), and are moved at 20° C. into a bath having 15 g/l $CuSO_4.5\ H_2O$, 20 g/l $H_2SO_4$, and as protective layer former 5 g/l sulfophthalic acid. The counterelectrodes (V4A) are connected as anodes, and the auxiliary electrodes (V4A-rods) are connected as cathodes; subsequently, a voltage of 8 V is applied for 30 seconds.

After this electrode activation, a direct voltage of 22 V is applied for 30 seconds between the sheets as anodes and the counterelectrodes as cathodes; subsequently, the sheets remain currentless in the bath for 3 minutes.

After the current-less retention time, the sheets are electrolytically colored at 13 V for 15 minutes.

The sheets have a uniform color on the inner and outer sides. (Light point tolerance pursuant to the Dr.-Lange-measuring device UME $1\pm5$ light points).

EXAMPLE 6

Two AlMg 1-sheets ($30\times40$ cm$^2$) are suspended at a distance of 20 mm from one another, are anodized (20 μm layer thickness), and are moved at 20° C. into a bath having 5 g/l $KMnO_4$, 5 g/l $H_2SO_4$, and as protective layer former 1 g/l phosphonobutanetricarbonic acid.

The counterelectrodes (V4A) are connected as anodes, and the auxiliary electrodes (V4A-rods) are connected as cathodes; subsequently, a voltage 8 V is applied for 30 seconds.

After this electrode activation, a direct voltage 22 V is applied for 40 seconds between the sheets as anodes and the counterelectrodes as cathodes; subsequently, the sheets remain current-less in the bath for 3 minutes.

After the current-less retention time, the sheets are electrolytically colored at 11 V for 8 minutes.

The sheets have a uniform color on the inner and outer sides. (Light point tolerance pursuant to the Dr.-Lange-measuring device UME $1\pm5$ light points).

For comparison, two sheets that were similarly suspended and provided with a 20 μm anodized oxide layer, were electrolytically colored without resorting to the inventive procedure. The inner sides of the sheets were 80–90 light points lighter than the outer sides.

The present invention is, of course, in no way restricted to the specific disclosure of the specification and examples, but also encompasses any modifications within the scope of the appended claims.

What I claim is:

1. A method for electrolytically coloring aluminum and aluminum alloys in a reproducible manner so that they are uniform in color, said method including the steps of:

anodically oxidizing aluminum or aluminum alloy to form an oxide layer;

anodically oxidizing in an anodic treatment via solution capable of forming a barrier layer and electrolytically coloring, said solution including a salt of an acid to effect a barrier layer alteration of the oxide that is to be colored in such a way that a uniform electrolytic coloring is possible; electrolytically coloring in said solution; the additional step, after anodic treatment and prior to coloring, of maintaining the aluminum or aluminum alloy in said solution for a current less waiting time of from 0.5 to 5 minutes; and prior to anodic treatment and subsequent coloring in said solution, of activating the counterelectrodes used during coloring by applying, for 5 to 30 seconds, a direct voltage of 2 to 9 V between the counterelectrodes, as anodes, and auxiliary electrodes, as cathodes.

2. A method according to claim 1, in which the electrolytis coloring is effected using alternating current.

3. A method according to claim 2, in which said solution contains at least one salt selected from the group consisting of salts of tartaric acid, boric acid, sulfosalicylic acid, citronic acid, and glycolic acid.

4. A method according to claim 1, including effecting anodic treatment at 15 to 30 V for 10 to 200 seconds.

* * * * *